US005219265A

United States Patent [19]

Recker

[11] Patent Number: 5,219,265

[45] Date of Patent: Jun. 15, 1993

[54] GRAPPLE ASSEMBLY

[75] Inventor: Roger L. Recker, Chillicothe, Ill.

[73] Assignee: Caterpillar Inc., Peoria, Ill.

[21] Appl. No.: 820,105

[22] Filed: Jan. 13, 1992

[51] Int. Cl.[5] ..... B66C 1/10

[52] U.S. Cl. ..... 414/731; 294/86.41; 294/88; 294/115

[58] Field of Search ..... 414/731, 694; 294/86.41, 106, 115, 88, 68.23

[56] References Cited

U.S. PATENT DOCUMENTS

| | | | |
|---|---|---|---|
| 2,639,937 | 5/1953 | Billings | 294/107 X |
| 3,038,620 | 6/1962 | Collin | 294/107 X |
| 4,212,577 | 7/1980 | Swanson | 414/731 X |
| 4,451,194 | 5/1984 | Keats et al. | 414/731 |
| 5,061,150 | 10/1991 | Rentschler | 294/88 X |

*Primary Examiner*—Michael S. Huppert
*Assistant Examiner*—Donald W. Underwood
*Attorney, Agent, or Firm*—William C. Perry

[57] ABSTRACT

In the installation of underground utilities it is common to utilize an earthmoving machine, such as hydraulic excavator, to dig a trench and aid in the placement of the individual pipe segments that comprise a conduit or pipeline. Normal placement of the pipe segments requires communication between the excavator operator and laborer that is positioned adjacent the pipeline in the trench. As the pipe segments are lowered into position, the laborer insures a proper connection of each joint and the overall support beneath the pipeline. The requirement of another individual in the trench is both inefficient and represents a significant increase in the cost of laying the pipeline. The present invention utilizes a grapple assembly to grasp the individual pipe segments to maneuver them into and within the trench. The grip on the pipe segment is sufficient to permit its insertion into the unfinished pipeline. In addition the grapple assembly is provided with tong assemblies that are mounted in a manner sufficient to allow them avoid contact the bedding material upon release of the pipe segment so as not to disturb the support of the pipeline or they may be utilized in a manner to slightly alter the configuration of the bedding material in the trench to accommodate pipe segments of varying diameter.

11 Claims, 2 Drawing Sheets

GRAPPLE ASSEMBLY

TECHNICAL FIELD

This invention relates generally to an apparatus which may be utilized to pick up and move cylindrical members and more particularly to an assembly that may be utilized to grasp and move individual pipe segments into a trench for coupling with a pipeline.

BACKGROUND ART

In the installation of underground utilities, it has frequently been desirable to utilize a hydraulic excavator to dig a trench for placement of an underground conduit or pipeline. Similarly, the same machine is utilized to lift and maneuver each segment of pipe into the trench for end to end attachment with other segments of pipe. Typically, the pipe segments would be lifted by heavy cables or straps that engage a hook positioned on the back of the excavating bucket. The pipe segments are maneuvered from a point on the ground adjacent the trench to a point within the trench. Once in the trench, connection of the pipe segment to the existing pipeline would rely heavily upon a laborer that is also located within the trench. The laborer is able to maneuver the pipe to align it with the existing pipeline and communicate instruction to the operator of the excavator to achieve proper elevational positioning. The laborer often needs to provide movement of the pipe segment in an axial direction with respect to the existing pipeline to achieve a proper connection since the excavator merely suspended the pipe segment from the bucket. After a secure connection is achieved, the laborer then must insure that the bedding material laid within the trench to support the pipeline has not been displaced by the maneuvering of the pipe segment during its connection with the rest of the pipeline. If the pipe has become unsupported, the laborer then moves bedding material under the pipe segment to achieve proper support. Alternatively, when the pipe segments are of a "bell-mouthed" configuration, the laborer must alter the bedding material to create a depression or divit to accommodate the increased diameter of the pipe segment in the area of the bell-mouth. While this has been an effective way to set pipe within a trench, the necessary presence of the operator within the trench is both costly and inefficient.

The present invention is directed to overcoming one or more of the problems as set forth above.

DISCLOSURE OF THE INVENTION

In one aspect of the present invention, a grapple assembly is provided that includes a main support beam that has a first and second end portion. A pair of abutment members are positioned in spaced relation to one another and are attached to the opposite end portions of the main support beam. A pair of grapple tongs are pivotally mounted to the main support beam about a common axis and extend therefrom in a first direction. A means is also provided for simultaneously actuating the grapple tongs between a first gripping position wherein the tongs are moved toward one another and a second releasing position, wherein the tongs are moved away from each other.

In another aspect of the invention a grapple assembly is provided that includes a main support beam having first and second end portions and a pair of abutment members fixed the the respective end portions of the mains support beam spaced relation to one another. A first grapple tong assembly is secured to an outer surface of the main support beam and includes a pair of spaced apart tong members. A wedge-shaped bar member extends between the tong members in a direction that is generally parallel to the main support beam. A second grapple tong assembly is also secured to the outer surface of the main support beam. The second grapple tong assembly comprises only a single tong assembly that has a wedge-shaped bar member that extends in a direction that is generally parallel to the main support beam. A means is provided for mounting the grapple tong assemblies to the main support beam about a common axis. An actuating means is provided that simultaneously actuates the grapple tongs between a first gripping position, wherein the tong assemblies are moved toward one another and a second releasing position, wherein the tong assemblies are moved away from each other.

With a grapple assembly as set forth above, a pipe segment can be engaged by the grapple tongs and held against the abutment members to securely grasp the pipe segment. The pipe segment can then be maneuvered into the trench by the grapple which will maintain enough of a grasp to move the pipe segment into engagement with the unfinished pipeline. Once in place, the pipe may be released without any undue disturbance of the bedding material through rotation of the tongs toward their open position. Alternatively, the grapple assembly may be utilized as a tool to perform minor alterations in the bedding material of the trench to accommodate pipe diameter that has varied diameters. By operating in such a fashion, the connecting and laying functions of creating a pipeline that have normally been performed with the aid of a nearby laborer, may now be accomplished by the operator of the excavator, thus eliminating the need for someone to be in the trench during connection of the pipe segments.

BEST MODE FOR CARRYING OUT THE INVENTION

Figure 1:
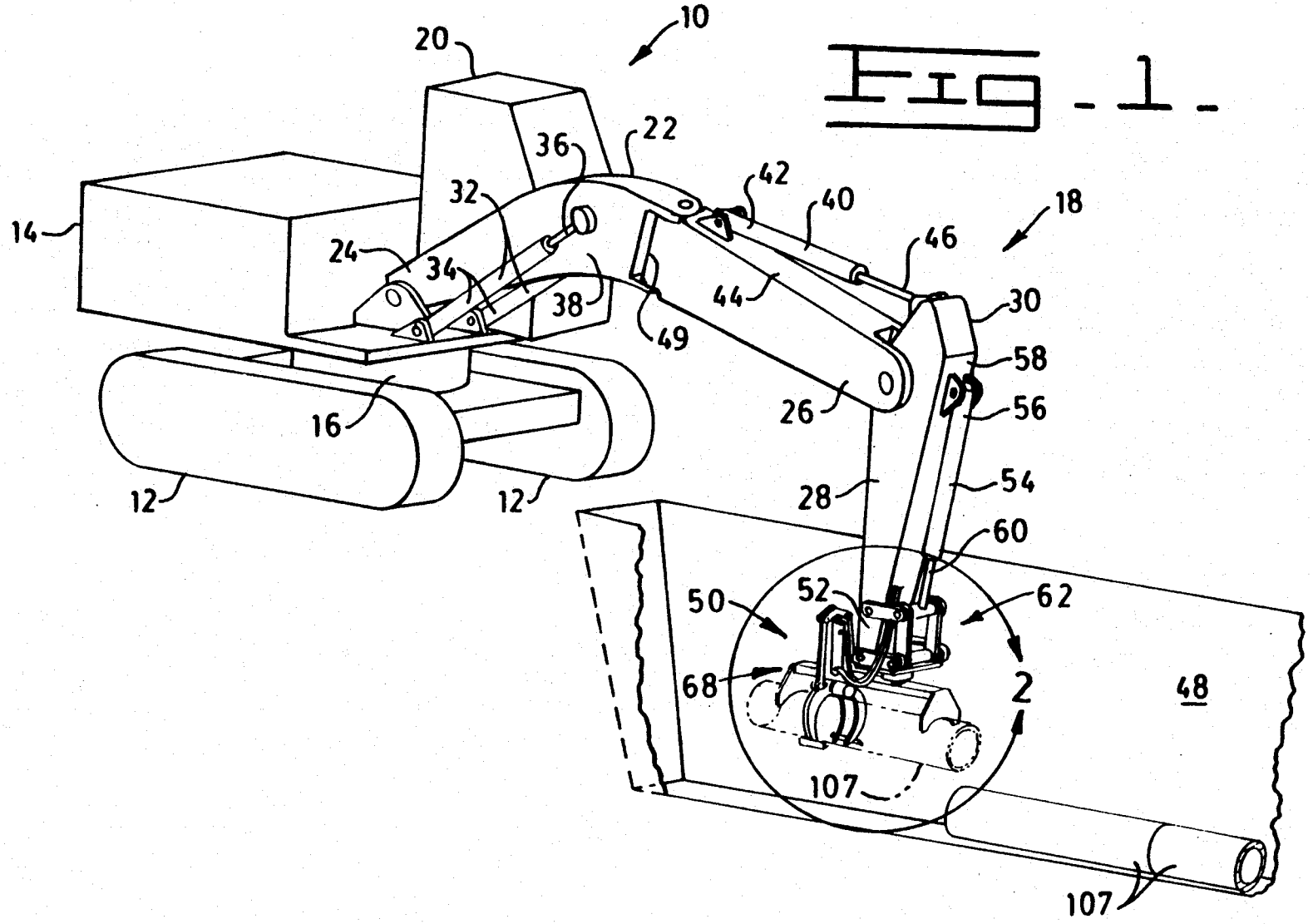
FIG. 1 is a diagrammatic perspective view of a hydraulic excavator that embodies the principles of the present invention.

Referring now to the drawings, and more particularly to FIG. 1, a hydraulic excavator 10 is shown that is supported upon a pair of spaced apart track assemblies 12. An upperstructure or house 14 serves as an enclosure for the engine and other power related components (not shown). The upperstructure is mounted to the track assemblies by a swing gear 16 that provides rotation of the upperstructure 14 with respect to the track assemblies throughout 360 degrees of rotation in a generally horizontal plane. A linkage arrangement 18 is mounted to the house at a location adjacent a cab 20 of the vehicle. The linkage arrangement 18 includes a boom 22 that has a first end portion 24 mounted to the upperstructure 14 for pivotal movement with respect thereto along a substantially vertical plane. A second or distal end 26 of the boom 22 extends forwardly from the vehicle and is in turn pivotally mounted to a secondary boom or stick 28, generally in the vicinity of a first end portion 30 of the stick 28.

The boom 22 is pivoted about its mounting to the upperstructure 14 by a first pair of hydraulic cylinders 32 that have a first end 34 mounted to the upperstructure 14 and a second end 36 mounted to an intermediate portion of the boom 38. A second hydraulic cylinder 40 has a first end 42 mounted to an upper plate 44 of the boom and a second end 46 mounted to the first end portion 30 of the stick 28. When actuated, the second cylinder 40 provides movement of the stick with respect to the boom in the same vertical plane.

To increase the maneuverability of the linkage arrangement 18 with respect to individual pipe sections that may randomly be laid along the edge of a trench 48, the boom 22 may be provided with a hinge 49 that is located in a generally central region of the boom. This construction permits a limited amount of lateral shifting between the first and second end portions 24 and 26 respectively.

One of a plurality of work implements 50 may be attached to a second end 52 of the stick 28 to perform various earth working tasks as will be discussed hereinafter. The work implement may be further manipulated with respect to the stick member by a third hydraulic cylinder 54 that has a first end 56 mounted to an upper plate 58 of the stick 28 and a second end 60 that is connected to a tilt linkage arrangement 62. The tilt linkage arrangement 62 includes a pair of links 64 and 66 (FIG. 2) that extend from the stick 28 and the mounting portion of the work implement 50 respectively to be joined to each other and with the second end 60 of the third hydraulic cylinder 54.

In order to dig a trench 48, the excavator must employ the use of a bucket (not shown). Once the trench has been dug, the bucket may be exchanged for another implement such as a grapple assembly as shown at 68 in FIG. 2. In order to provide a quick exchange of implements, it is desirable to include in the mounting arrangement, a quick coupling device shown generally at 70, which may include any one of the numerous designs that are readily available. One such coupler that has been known to work extremely well in these types of applications is disclosed in U.S. Pat. No. 4,854,813, issued to DeGeeter et al. on Aug. 8, 1989.

It is to be understood that in order to gain the maximum benefit from the subject design, it is recommended that the implement is utilized in conjunction with an excavator that employs an automatic dig function. In such a system, the operator can automatically control the depth and the slope of a trench through the use of electronic controls incorporated into the linkage control arrangement of the excavator. A typical system that offers such capability is disclosed in U.S. Pat. No. 5,065,326, issued to W. C. Sahm on Nov. 12, 1991. When a system such as this is utilized, the initial requirement for an individual to be positioned within the trench is eliminated.

Figure 2:
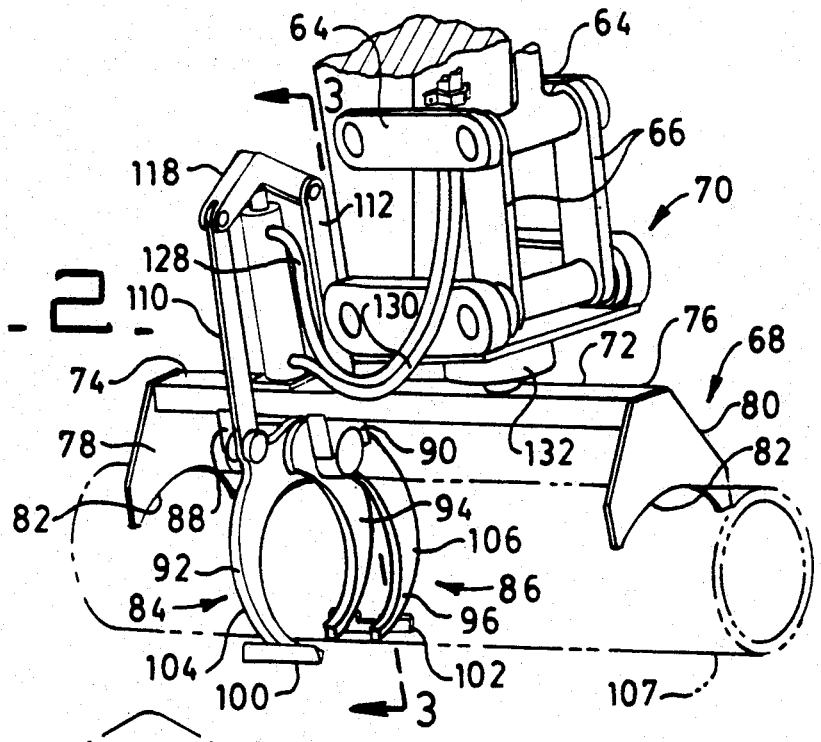
FIG. 2 is an enlarged view of the area indicated in FIG. 1.
Figure 3:
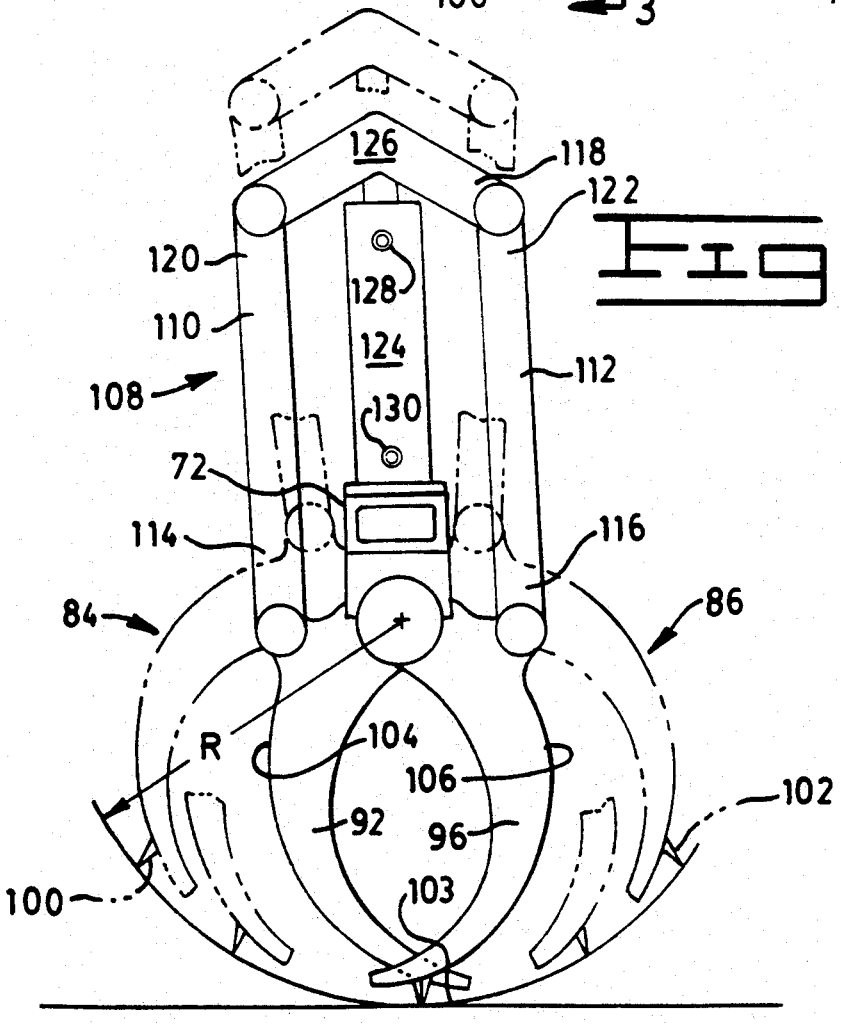
FIG. 3 is a cross-sectional view of the grapple tong arrangement taken along lines 3—3 of FIG. 2.

Turning now to FIGS. 2 and 3, the grapple assembly 68 includes a main support beam 72 that has a first and second end portion 74 and 76 respectively. First and second abutment members 78 and 80 are attached to the respective first and second end portions 74 and 76 of the main support beam 72. Each abutment portion 78 and 80 extends outwardly from the main support beam in a first, or downward direction as viewed in the drawings, and has an arcuate surface 82 formed thereon.

A pair of grapple tong assemblies 84 and 86 are pivotally mounted to the main support beam by a pair of spaced apart bracket members 88 and 90. The tong assemblies are positioned generally toward the first end portion 74 of the main support beam 72 and extend therefrom toward the first or outward direction. Both tong assemblies 84 and 86 are pinned between the bracket members for rotation about a common axis X with respect to the main support beam. The first tong assembly 84 is formed from a single tong member 92 while the second tong assembly 86 consists of a pair of identical tong members 94 and 96. The second pair of tongs 94 and 96 are longitudinally spaced apart and are located on a side opposite that of the first tong 92. A plurality of bushings 98 are positioned between the individual tongs and the brackets to permit relative rotation and axial positioning of the tongs.

Each tong assembly 84 and 86 has a wedge-shaped bar member 100 and 102 respectively fixed to an outer surface 104 and 106 of the respective tongs 84 and 86 and is positioned to extend longitudinally or parallel to the main support beam 72. It can be seen in FIG. 3 that the tong assemblies are generally arcuate and are curved toward each other. Being so configured, they may be maneuvered toward and away from each other to create a curved receptacle that will grasp a cylindrical object of varying size such as a segment of pipe or conduit 107, shown in phantom lines in FIGS. 1 and 2. When rotated to their maximum closed position, the bar members 100 and 102 are brought together to form a common edge 103 at their point of contact.

Rotation of the tong assemblies 84 and 86 is caused by an actuating means 108 that is primarily secured to the main support beam 72 on a second or opposite side of the main support beam from that of the tong assemblies. The actuating means 108 includes a pair of links 110 and 112. The actuating links 110 and 112 have respective first end portions 114 and 116 that are connected to the respective first and second tong members 92 and 94. Both links extend from their respective connections with the tong assemblies toward the second or upper side of the main support beam 72 as viewed in FIGS. 2 and 3. The links 110 and 112 are maintained in spaced, generally parallel relationship with one another by a cross-brace 118 that is connected to the respective second end portions 120 and 122 of the links. A hydraulic cylinder 124 is positioned between the main support beam 72 and a central portion 126 of the cross-brace 118. The cylinder is extendable to move the cross-brace away from the main support beam whereupon the links cause the tongs to be drawn away from each other. Conversely, the cylinder is retractable to draw the cross-brace back toward the main support beam, thus causing the tong assemblies to close. Extension and retraction of the cylinder is accomplished by selectively supplying fluid under pressure to the cylinder via a pair of conduits 128 and 130. The conduits 128 and 130 extend along the linkage arrangement 18 of the excavator to the house 14 where they are connected to a suitable pump and control mechanism (not shown) to permit the selective delivery of pressurized fluid to the cylinder 124.

A rotary coupler, shown generally at 132, is mounted between the main support beam 72 and a mounting plate 134 (FIG. 2) that is secured to tilt linkage arrangement 62. The rotary coupler 132 may take the form of any suitable coupler that is currently available from several different suppliers and need not be described in greater detail. The rotary coupler is positioned toward the second end portion 76 of the main support beam 72 to allow sufficient room for the actuating means 108 to clear the linkage structure as it rotates.

INDUSTRIAL APPLICABILITY

When utilizing the subject invention to assemble a pipeline, for example, the excavator 10 must first attach a bucket to dig a trench 48 of proper dimensions and grade. As previously set forth, this function may be accomplished automatically through pre-programming of the excavator controls. Once a portion of the trench has been prepared that has sufficient length to accommodate at least one length of a pipe segment 107, the operator can quickly uncouple the bucket and attach the grapple assembly 68. If the configuration of the pipe segments is such that the external diameter is uniform, the operator will maneuver the grapple assembly 68 and the excavator linkage 18 to engage a length of pipe 107. By extending the hydraulic cylinder 124 of the actuating means 108, the tong members 92 and 94 are drawn apart a sufficient distance to clear the pipe as the abutment portions 78 and 80 are brought into contact with the pipe. The cylinder 124 may then be retracted to bring the tongs 92 and 94 into firm grasping contact with the the pipe segment. Once secured by the tong assemblies, the pipe segment may be moved into the trench 48 wherein one end of the pipe segment is forced into engagement with the unfinished pipeline. Since the tong assemblies 84 and 86 pivot about the same centerline, the path of rotation moves them directly up and away from the pipe segment and the bedding material in a manner wherein the bedding material is not contacted by either tong assembly (FIG. 3).

If the pipe segments 107 are of the bell-mouth configuration, having one end larger than the other, the operator must prepare a depression in the bedding material in the trench to accommodate the enlarged diameter. This is easily accomplished by retracting the actuating cylinder 124 to its maximum point to bring the two wedge-shaped bar members 100 and 102 together. The bar members may then be inserted into the bedding material under slight pressure, at a location that corresponds to the location of the enlarged end of the pipe segment 107. Upon extension of the actuating cylinder, the tong assemblies 84 and 86 are moved apart to create a round depression in the bedding material sufficient to accommodate the increased pipe diameter.

With a grapple assembly 68 as set forth above, an operator of an excavator 10 may set pipe of uniform diameter in a manner that will not disturb the bedding material that undergirds each pipe segment. Alternatively, the grapple assembly is also adapted to be utilized as a tool to prepare a trench 48 to accommodate pipe of a bell-mouthed configuration. This provides an operator with a very high degree of versatility. Further, when utilized with a machine that has automatic digging capabilities, the operator has the capability of preparing a trench and setting pipe without the aid of another individual positioned within the trench.

Other aspects, objects and advantages of this invention can be obtained from a study of the drawings, the disclosure and the appended claims.

I claim:

1. A grapple assembly, comprising:

a main support beam having first and second end portions;

a pair of abutment members positioned in spaced relation to one another and being attached to the opposite end portions of the main support beam;

a pair of grapple tong assemblies are pivotally mounted to the main support beam about a common axis and extending therefrom in a first direction;

a bar member mounted on each of the grapple tong assemblies and being positioned to extend in a direction that is generally parallel to the main support beam, and means for simultaneously actuating the grapple tong assemblies between a first gripping position wherein the tongs assemblies are moved toward one another to a position wherein said bar members are in abutment with one another to form a common edge therebetween and a second, releasing position wherein the tongs assemblies are moved away from each other.

2. A grapple assembly as set forth in claim 1 wherein the abutment members have an arcuate engagement surface formed thereon that are positioned to face toward said first direction.

3. A grapple assembly as set forth in claim 1 wherein the grapple tong assemblies are positioned between a pair of mounting brackets that are longitudinally spaced along the main support beam to position the tong assemblies generally on the first end portion of the main support beam thereof.

4. A grapple assembly as set forth in claim 1 wherein the main support beam is selectively connectable to the linkage arrangement of a hydraulic excavator and is sufficient for grasping and maneuvering cylindrical objects of preselected length.

5. A grapple assembly as set forth in claim 4 wherein a rotary coupler is positioned between the excavator linkage and the main support beam at a location that is generally on the second end portion of the main support beam, to provide selective rotation of the grapple assembly with respect to the excavator linkage.

6. A grapple assembly as set forth in claim 1 wherein the actuating means further includes:

a pair of actuating links having a first end portion pivotally connected to respective ones of each grapple tong assembly and being positioned on opposite sides of the main support beam to extend from the grapple tong assemblies in spaced, parallel relation to each other to position a second end portion of the actuating links at a location that is on the opposite side of the main support beam from the grapple tong assemblies;

a cross-brace extending between the second end portions of the actuating links and being pivotally connected thereto; and a fluid actuated cylinder positioned between the main support beam and the cross-brace and being sufficient for moving the cross-brace toward and away from the main support beam to, in turn, move the grapple tong assemblies between their first and second positions.

7. A grapple assembly as set forth in claim 5 wherein a quick coupling device is positioned between the rotary coupler and the excavator linkage.

8. A grapple assembly as set forth in claim 1 wherein one of the grapple tong assemblies has a pair of tong members spaced longitudinally from one another and the other of the tong assemblies includes a single tong member.

9. A grapple assembly as set forth in claim 1 wherein the bar members are wedge-shaped and are connected to an outer surface of each of the respective grapple tong assemblies.

10. A grapple assembly, comprising:

a main support beam having first and second end portions;

a pair of abutment members positioned in spaced relation to one another and being attached to the opposite end portions of the main support beam;

a first grapple tong assembly having a single tong member and a wedge-shaped bar member that extends in a direction that is generally parallel to the main support beam and is secured to an outer surface thereof;

a second grapple tong assembly having a pair of spaced apart tong members and a wedge-shaped bar member that extends between the tong members in a direction that is generally parallel to the main support beam and is secured to an outer surface thereof;

means for pivotally mounting the first and second grapple tong assemblies to the main support beam along a common axis; and means for simultaneously actuating the grapple tong assemblies between a first gripping position wherein the grapple tong assemblies are moved toward one another to a point wherein the respective wedge-shaped bar members are in abutment with one another to form a common edge therebetween and a second, releasing position wherein the grapple tongs assemblies removed away from each other.

11. A grapple assembly as set forth in claim 10 wherein the mounting means includes a pair of longitudinally spaced bracket members that extend from the main support beam to rotatably mount the first and second grapple tong assemblies in a manner wherein the single grapple tong member of the first grapple tong assembly is positioned between the pair of tong members of the second grapple tong assembly.

* * * * *

UNITED STATES PATENT AND TRADEMARK OFFICE

CERTIFICATE OF CORRECTION

PATENT NO. : 5,219,265

DATED : June 15, 1993

INVENTOR(S) : Roger L. Recker

It is certified that error appears in the above-identified patent and that said Letters Patent is hereby corrected as shown below:

Claim 10, column 8, line 11, "removed" should be "are moved".

Signed and Sealed this

First Day of February, 1994

Bruce Lehman

*Attest:*

BRUCE LEHMAN

*Attesting Officer*

*Commissioner of Patents and Trademarks*